US008221019B2

(12) United States Patent
Greer, Jr. et al.

(10) Patent No.: US 8,221,019 B2
(45) **Date of Patent: *Jul. 17, 2012**

(54) TUBE WITH RESILIENT APPLICATOR FOR DISPENSING TEXTURE MATERIALS

(75) Inventors: Lester R. Greer, Jr., Sandpoint, ID (US); Randal W. Hanson, Bellingham, WA (US)

(73) Assignee: Homax Products, Inc., Bellingham, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/901,400

(22) Filed: Oct. 8, 2010

(65) Prior Publication Data

US 2011/0081488 A1 Apr. 7, 2011

Related U.S. Application Data

(63) Continuation of application No. 12/332,272, filed on Dec. 10, 2008, now abandoned, which is a continuation of application No. 11/810,587, filed on Jun. 5, 2007, now abandoned, which is a continuation of application No. 11/175,777, filed on Jul. 5, 2005, now Pat. No. 7,226,232, which is a continuation of application No. 10/215,530, filed on Aug. 8, 2002, now Pat. No. 6,913,407.

(60) Provisional application No. 60/311,424, filed on Aug. 10, 2001.

(51) Int. Cl.
*B05C 11/00* (2006.01)

(52) U.S. Cl. ..... 401/266

(58) Field of Classification Search ..... 401/183–185, 401/196, 202, 207, 261, 262, 265, 266
See application file for complete search history.

(56) References Cited

U.S. PATENT DOCUMENTS 693,518 A 2/1902 Hamilton
(Continued)

FOREIGN PATENT DOCUMENTS

CA 2224042 5/2006
(Continued)

OTHER PUBLICATIONS

USPTO, Office Action, U.S. Appl. No. 12/825,271, May 12, 2011, 8 pages.

(Continued)

*Primary Examiner* — Huyen Le
(74) *Attorney, Agent, or Firm* — Michael R. Schacht; Schacht Law Office, Inc.

(57) ABSTRACT

A method of applying texture material to a destination surface defining a pre-textured portion formed by a spray system and an untextured portion, comprising the following steps. A flexible container, texture, material, a sponge base, a resilient sponge are provided. The resilient sponge is adhered to the sponge base to form a sponge assembly. The texture material is arranged within the container chamber, and the sponge member is fixed relative to the container. Texture material is forced out of the container member and onto an applicator surface. At least a portion of the texture material on the applicator surface is transferred to the untextured portion of the destination surface by displacing the container member along the dispensing axis towards the destination surface with the applicator surface substantially parallel to the destination surface. The container member is then displaced away from the destination surface along the dispensing axis with the applicator surface substantially parallel to the destination surface such that an exposed portion of the particulate material on the untextured portion of the destination surface stands out from the destination surface and is visually perceptible.

5 Claims, 3 Drawing Sheets

U.S. PATENT DOCUMENTS

| | | | | | |
|---|---|---|---|---|---|
| 912,028 | A | | 2/1909 | Prout | |
| 1,390,126 | A | | 9/1921 | Halaska, Jr. | |
| 1,436,254 | A | | 11/1922 | Henry, Jr. | |
| 1,602,642 | A | | 10/1926 | Brathwaite | |
| 1,674,510 | A | | 6/1928 | Hagman | |
| 2,197,052 | A | | 4/1940 | Lowen | |
| 2,271,285 | A | | 1/1942 | Bussert | |
| 2,361,407 | A | | 10/1944 | McNair | |
| 2,528,911 | A | | 11/1950 | Porter | |
| 2,674,005 | A | | 4/1954 | Simon | |
| 2,715,750 | A | | 8/1955 | Vail | |
| 2,962,743 | A | | 12/1960 | Henriksson | |
| 3,016,561 | A | | 1/1962 | Hulsh | |
| 3,032,803 | A | | 5/1962 | Walshauser | |
| 3,072,953 | A | | 1/1963 | Bunke | |
| 3,087,654 | A | | 4/1963 | Moore | |
| 3,121,906 | A | * | 2/1964 | Hulsh | 401/202 |
| 3,135,007 | A | | 6/1964 | Howell | |
| 3,271,810 | A | | 9/1966 | Raffe | |
| 3,688,401 | A | | 9/1972 | Harman | |
| 3,744,079 | A | | 7/1973 | Krause | |
| 3,756,732 | A | * | 9/1973 | Stoffler | 401/202 |
| 3,761,992 | A | | 10/1973 | Schneller | |
| 3,797,946 | A | | 3/1974 | Witzmann et al. | |
| 3,846,060 | A | | 11/1974 | Otis | |
| 3,878,581 | A | | 4/1975 | Perna | |
| 3,892,039 | A | | 7/1975 | Fisher | |
| 4,123,005 | A | | 10/1978 | Blunk | |
| 4,211,501 | A | | 7/1980 | Pedroso et al. | |
| 4,230,356 | A | | 10/1980 | O'Connor | |
| 4,295,242 | A | | 10/1981 | Dixon | |
| 4,338,718 | A | | 7/1982 | Olkkola | |
| 4,364,521 | A | | 12/1982 | Stankowitz | |
| 4,586,890 | A | | 5/1986 | Marchbanks | |
| 4,654,919 | A | | 4/1987 | Liberman | |
| 4,674,903 | A | | 6/1987 | Chen | |
| 4,934,854 | A | | 6/1990 | Vesley et al. | |
| 5,008,970 | A | | 4/1991 | Tsai | |
| 5,018,956 | A | | 5/1991 | Lemaster | |
| 5,033,951 | A | | 7/1991 | Cook | |
| 5,037,011 | A | * | 8/1991 | Woods | 222/394 |
| D326,593 | S | | 6/1992 | Ward | |
| D332,901 | S | | 2/1993 | Campbell | |
| 5,341,970 | A | | 8/1994 | Woods | |
| 5,351,357 | A | | 10/1994 | Liberman | |
| 5,437,074 | A | | 8/1995 | White et al. | |
| 5,440,776 | A | | 8/1995 | Kartler | |
| D362,604 | S | | 9/1995 | White et al. | |
| 5,577,851 | A | * | 11/1996 | Koptis | 401/202 |
| 5,638,900 | A | * | 6/1997 | Lowenstein et al. | 165/168 |
| 5,638,990 | A | | 6/1997 | Kastberg | |
| 5,675,860 | A | | 10/1997 | Campbell | |
| 5,695,788 | A | | 12/1997 | Woods | |
| 5,988,923 | A | | 11/1999 | Arai | |
| D420,882 | S | | 2/2000 | Majolo et al. | |
| 6,035,536 | A | | 3/2000 | Dewberry | |
| 6,219,878 | B1 | | 4/2001 | Dewberry | |
| 6,334,727 | B1 | | 1/2002 | Gueret | |
| 6,351,888 | B1 | | 3/2002 | Brown et al. | |
| D468,980 | S | | 1/2003 | Woods | |
| 6,578,229 | B1 | | 6/2003 | Dziallas et al. | |
| 6,880,198 | B1 | | 4/2005 | Hazard | |
| 6,913,407 | B2 | * | 7/2005 | Greer et al. | 401/266 |
| 7,189,022 | B1 | | 3/2007 | Greer, Jr. et al. | |
| 7,226,232 | B2 | * | 6/2007 | Greer et al. | 401/266 |
| D605,911 | S | | 12/2009 | Lian et al. | |
| 7,744,299 | B1 | * | 6/2010 | Greer et al. | 401/266 |

FOREIGN PATENT DOCUMENTS

| | | |
|---|---|---|
| FR | 2792296 | 10/2000 |
| WO | 8904796 | 6/1989 |

OTHER PUBLICATIONS

Schacht Law Office, Inc., U.S. Appl. No. 12/825,271, Sep. 12, 2011, 8 pages.

Homax Products, Inc., Caulk Finisher Product, Web site http://www.homaxproducts.com/products/kitchenbath/01/index.html, 1988, 1 page.

USPTO, Office Action, U.S. Appl. No. 12/069,367, Sep. 20, 2011, 18 pages.

DAP Inc., Dap Patch Stick product, 1994, Dayton, OH.

* cited by examiner

TUBE WITH RESILIENT APPLICATOR FOR DISPENSING TEXTURE MATERIALS

RELATED APPLICATIONS

This application is a continuation of pending U.S. patent application Ser. No. 12/332,272 filed December 10, 2008.

U.S. application Ser. No. 12/332,272 is a continuation of U.S. patent application Ser. No. 11/810,587 filed Jun. 5, 2007, which is now abandoned.

U.S. patent application Ser. No. 11/810,587 is a continuation of U.S. patent application Ser. No. 11/175,777 filed Jul. 5, 2005, now U.S. Pat. No. 7,226,232 issued Jun. 5, 2007.

U.S. patent application Ser. No. 11/175,777 is a continuation of U.S. patent application Ser. No. 10/215,530 filed Aug. 8, 2002, now U.S. Pat. No. 6,913,407 issued Jul. 5, 2005.

U.S. patent application Ser. No. 10/215,530 claims benefit of U.S. Provisional Patent Application Ser. No. 60/311,424 filed Aug. 10, 2001.

The contents of all related applications listed above are incorporated herein by reference.

TECHNICAL FIELD

The present invention relates to the application of coating materials and, in particular, to the systems and methods for dispensing texture material containing particulate material to a surface such as a wall or ceiling.

BACKGROUND OF THE INVENTION

To form walls, modern building methods typically employ sheets of wall material nailed and/or screwed to wall studs. The wall material may be coated with a texture material appropriate for either interior or exterior walls.

Texture materials can be applied to a destination surface in a number of different ways. For large surface areas, the texture material is typically applied with a sprayer system. Sprayer systems may be airless or may mix the texture material with a stream of pressurized air. The source of pressurized air may be a compressor, storage tank, or hand operated pump.

In other cases, such as touch up or repair of a wall or ceiling surface, only a small area need be covered with texture material. For small surfaces areas, the texture material is preferably dispensed using an aerosol system. Aerosol systems typically employ a container assembly, valve assembly, nozzle assembly, and propellant. The propellant pressurizes the texture material within the container such that, when the valve is opened, the texture material flows out of the nozzle assembly. The nozzle assembly is typically designed to deposit the texture material on the destination surface in selected one of a plurality of predetermined texture patterns.

The present invention is of particular relevance to the application of stucco or "sand texture" texture materials to small surface areas, and those applications will be described herein in detail. Stucco texture materials contain, in addition to a carrier and base, what will be referred to herein as a "particulate" material. The particulate material in stucco is typically formed by sand or other similar materials.

The need exists for improved systems and methods for applying stucco texture material to relatively small surface areas.

SUMMARY OF THE INVENTION

The present invention may be embodied as a method of applying texture material to a destination surface defining a pre-textured portion formed by a spray system and an untextured portion comprising the following steps. A flexible container defining a container opening, a container chamber, a first threaded surface, and a dispensing axis is provided. Texture material comprising a base, a carrier, and particulate material, where the particulate material is at least one of sand, perlite, cork, polystyrene chips, and foam is also provided. A sponge base defining a base opening and a second threaded surface and a resilient sponge member defining a substantially planar applicator surface and a sponge opening are provided. A sponge assembly is formed by adhering the sponge member to the sponge base such that the base opening and sponge opening are substantially aligned along the dispensing axis and the dispensing axis is substantially perpendicular to the applicator surface. The texture material is arranged within the container chamber. The sponge assembly is displaced such that the first threaded surface engages the second threaded surface to fix the sponge member relative to the container. Deliberate manual force is applied to the container to force the texture material in the container chamber out of the container member and onto the applicator surface through the container opening. At least a portion of the texture material on the applicator surface is transferred to the untextured portion of the destination surface by displacing the container member along the dispensing axis towards the destination surface with the applicator surface substantially parallel to the destination surface. The container member is then displaced away from the destination surface along the dispensing axis with the applicator surface substantially parallel to the destination surface such that an exposed portion of the particulate material on the untextured portion of the destination surface stands out from the destination surface and is visually perceptible. The carrier is allowed to evaporate such that the base adheres the particulate material to the destination surface to form a coat of new texture material that substantially matches an appearance of the textured portion of the destination surface formed by the spray system.

DETAILED DESCRIPTION OF THE INVENTION

Figure 1:
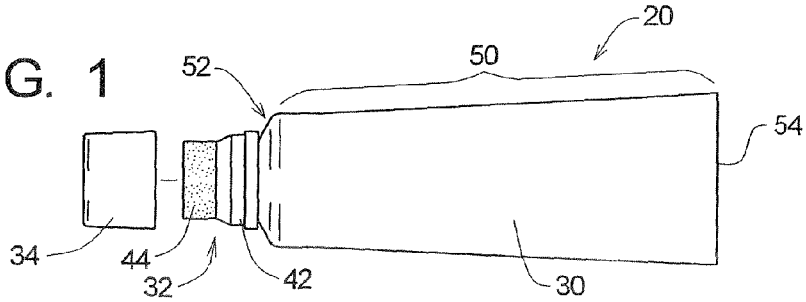
FIG. 1 is an elevational view depicting a dispensing system constructed in accordance with, and embodying the principals in the present invention.
Figure 2:
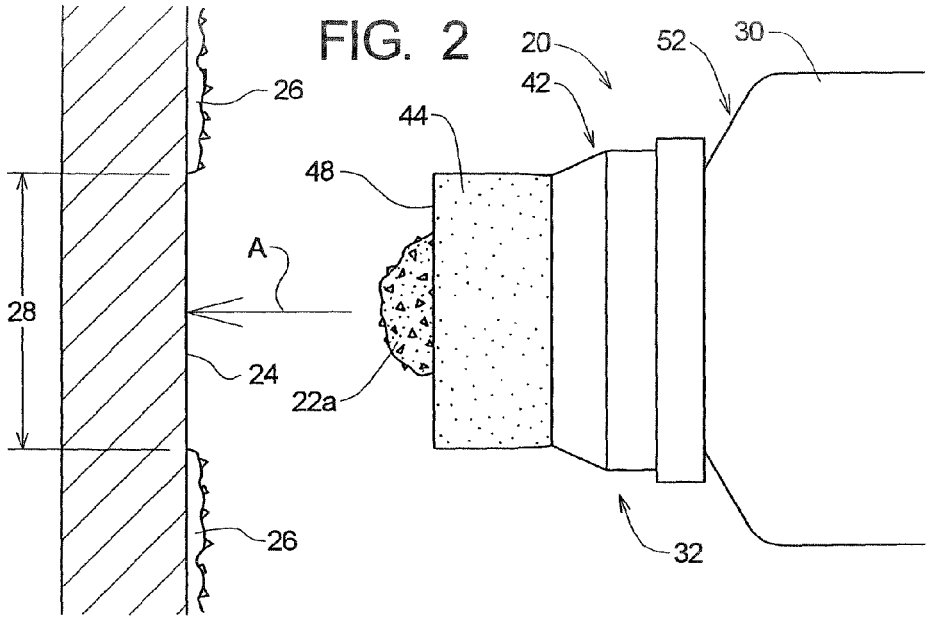
FIGS. 2 and 3 depict a method of using the system shown in FIG. 1 to apply texture material to a wall or ceiling surface.
Figure 3:
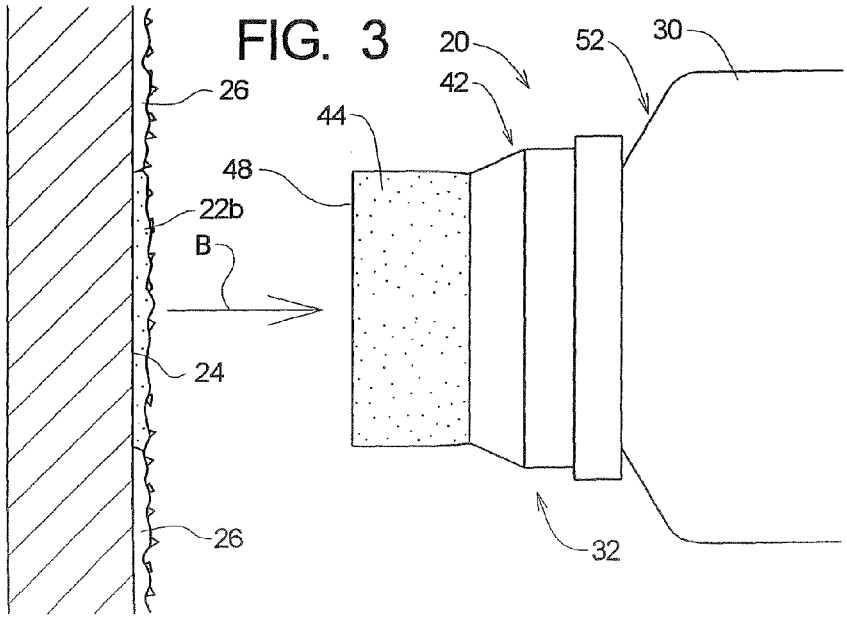

Referring initially to FIG. 1, depicted therein is a dispensing system 20 constructed in accordance with, and embodying, the principals of the present invention. As shown in FIGS. 2 and 3, the dispensing system 20 is used to apply new texture material 22 to a wall or ceiling surface 24. Existing material 26 is present on the exemplary surface 24, and an area 28 to be patched is shown in FIG. 2. The dispensing system 20 is of particular significance in the context of patching the area 28 of the wall surface 24 to match the existing texture material 26.

FIG. 2 also shows new texture material, indicated by reference character 22*a*, in the process of being dispensed from the system 20. FIG. 3 shows, as indicated by reference character 22*b*, the new texture material 22 applied to the surface 24 over the area 28 to be patched.

Texture material typically comprises a base 36, a particulate 38, and a carrier 40. The base 36 typically comprises a binder, a pigment, and filler material. The binder binds the remaining materials together and to the surface 24 to be coated. The pigment provides color to the applied coating. The filler is typically an inexpensive material that provides bulk to the coating without interfering with the function of the pigment or binder.

The particulate 38 in the texture material of the present invention is large enough to be visible to the unaided eye. The particulate 38 is typically sand, perlite, cork, polystyrene chips, foam, or the like. The particulate 38 provides a desirable aesthetic "look" and in some cases a functional purpose such as wear resistance or sound deadening.

The carrier 40 is typically oil or water that forms a solvent for the base 36 and thus allows the materials 22 to be in a liquid or plastic form when not exposed to air. Exposure to air causes the carrier 40 to evaporate or dry, leaving the base in a hardened form. The carrier 40 is represented by dots in the drawings; no dots are used when the texture material depicted has hardened.

The present invention is most significant in the context of patching a ceiling surface with what is referred to as stucco texture material. The dispensing system 20 may be used to dispense other texture materials, such as sand texture or stucco, but is of primary significance when applying acoustic texture material, and that application of the present invention will be described below in detail.

In the following discussion, the physical structure of the dispensing system 20 will be described in further detail. Following that, a method of using the dispensing system 20 to apply the new texture material 22 to the surface 24 will be described in detail.

Figure 4:
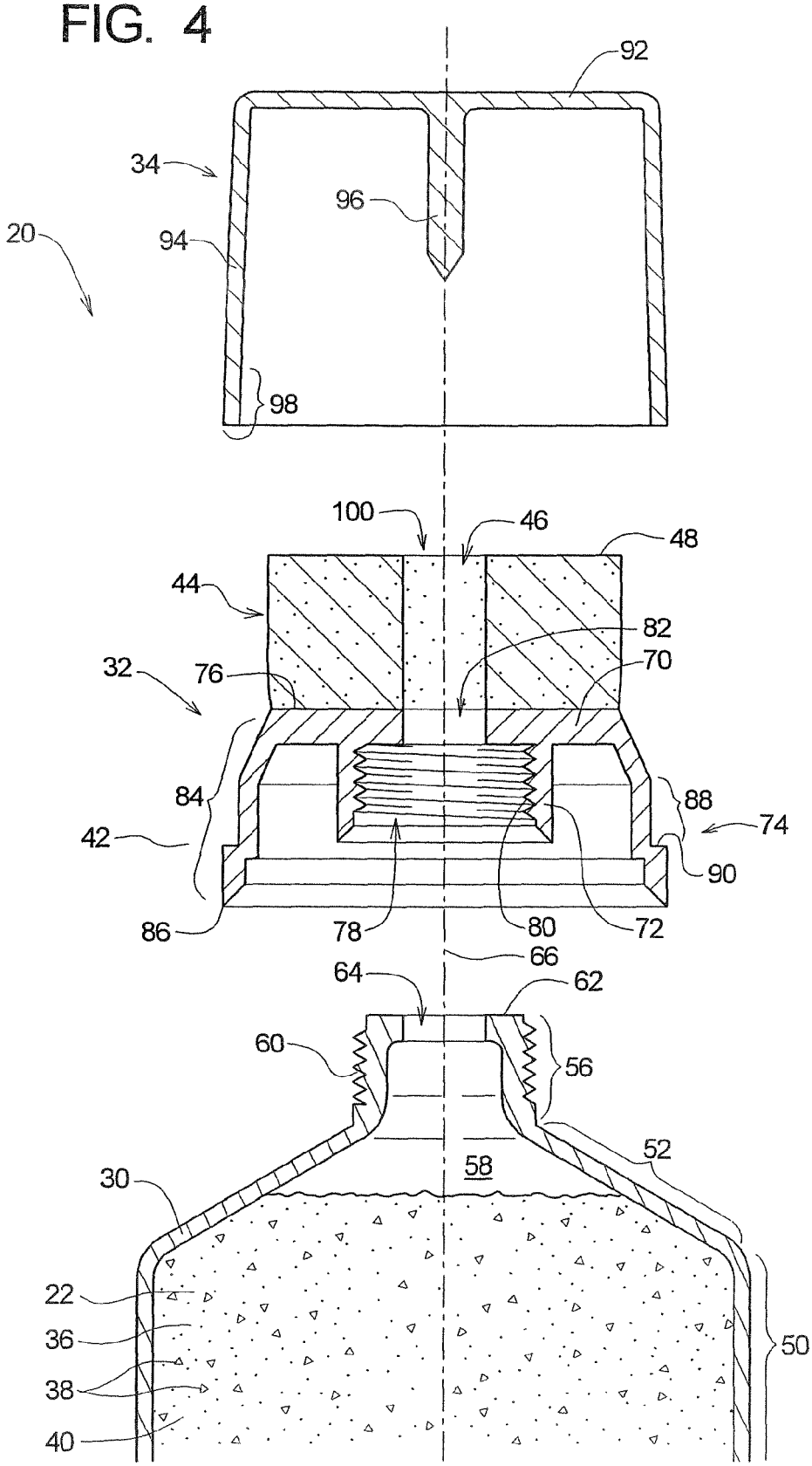
FIG. 4 is an exploded section view depicting a portion of the dispensing system of FIG. 1.
Figure 5:
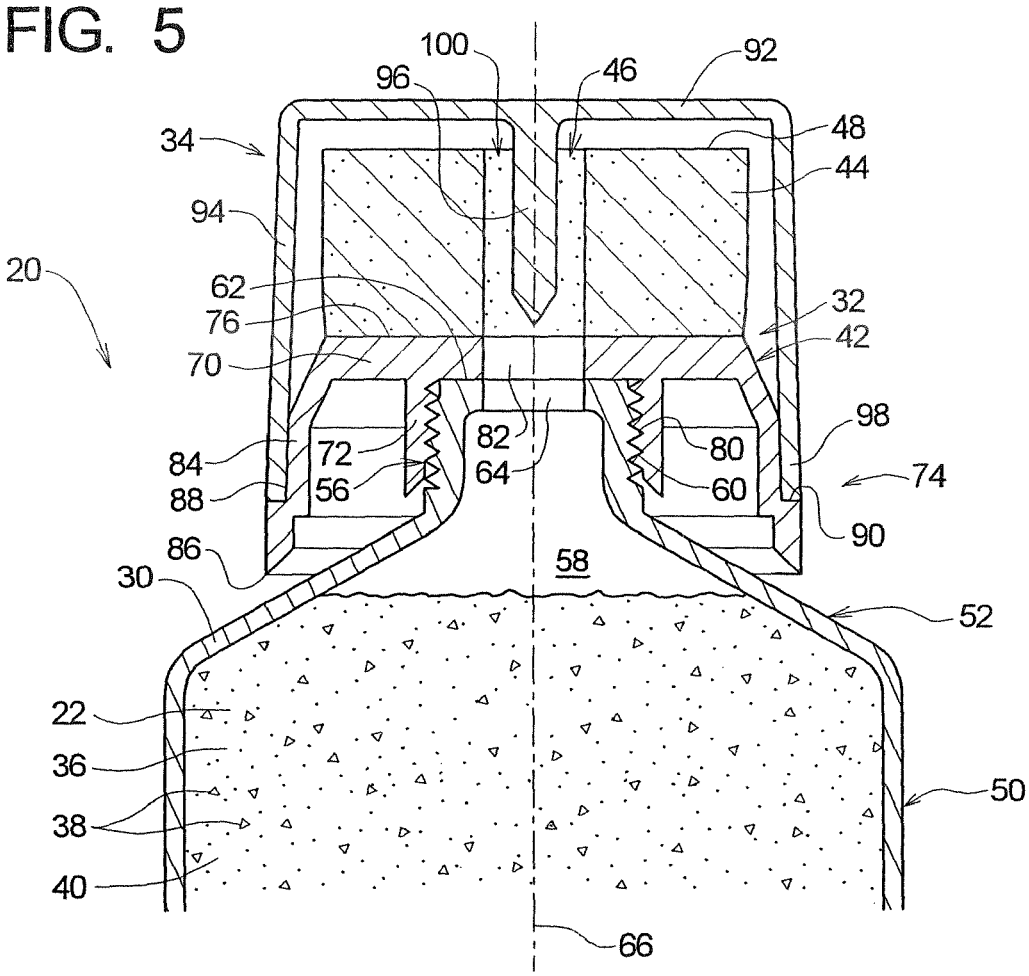
FIG. 5 is a section view depicting a portion of the dispensing system of FIG. 1.

Referring now to FIGS. 4 and 5, it can be seen that the exemplary dispensing system 20 comprises a container 30, a sponge assembly 32, and a cap member 34. The exemplary sponge assembly 32 comprises a sponge base 42 and sponge member 44. The sponge member 44 defines a sponge opening 46 and an applicator surface 48. The exemplary sponge base 42 is made of rigid plastic and is adapted to engage both the container 30 and the cap member 34. The sponge member 44 is relatively resilient and is secured by adhesive or the like to the sponge base 42.

The sponge base 42 and sponge member 44 of the exemplary sponge assembly 32 are made of different materials. In particular, the sponge base 42 is made of a relatively rigid plastic and the sponge member 44 is made of a resilient material such as synthetic or natural sponge or foam. This use of two different materials for the parts 42 and 44 simplifies the manufacturing process and reduces cost, but one of ordinary skill in the art will recognize that certain materials and manufacturing techniques may be used to manufacture the sponge assembly 32 out of a single piece of material. In this case, the sponge base 42 and sponge member 44 would be integrally formed and not separate members secured together as in the exemplary embodiment described herein. The exemplary sponge base 42 and sponge member 44 will be described in further detail below.

Referring now for a moment to FIG. 1, it can be seen that the container 30 comprises a main portion 50, a shoulder portion 52, and a closed end 54. FIGS. 4 and 5 show that the container 30 also comprises an opening portion 56.

The container 30 is preferably made of a soft or resilient plastic material that is substantially impermeable to air and can be deformed by squeezing by hand. Other materials, such as paper, paperboard, metal, or the like may be used.

The exemplary main portion 50 starts out during manufacture as a cylindrical tube having a fill opening at one end and the shoulder and opening portions 52 and 56 at the other end. The new texture material 22 is introduced into a container chamber 58 defined by the container 30. The fill opening is then closed to form the closed end 54.

Formed on the opening portion 56 is an external threaded surface 60 and a dispensing surface 62. A container opening 64 is formed in the dispensing surface 62. When the closed end 54 is formed, the new texture material 22 in the material chamber 58 may thus exit the container 30 only through the container opening 64. A dispensing axis 66 extends through the container opening 64. In the exemplary system 20, the opening portion 56 and container opening 64 are generally cylindrical and their longitudinal axes are aligned with each other and with the dispensing axis 66.

As shown in the drawing, again with reference to FIGS. 4 and 5, the sponge base 42 comprises a plate portion 70, a mounting portion 72, and a skirt portion 74. The plate portion 70 defines a sponge surface 76 to which is attached the sponge member 44.

The mounting portion 72 defines a mounting cavity 78 having an internal threaded surface 80. The external threaded surface 60 and internal threaded surface 80 are complimentary such that the sponge base 42 may be threaded onto the container 30 to attach the sponge assembly 32 to the container 30.

A base opening 82 is formed in the sponge base 42. In particular, the base opening 82 extends from the sponge surface 76 to the mounting cavity 78. When the threaded surfaces 60 and 80 are engaged with each other, the base opening 82 is substantially aligned with the container opening 64. In addition, with the sponge member 44 secured to the sponge surface 76, the sponge opening 46 is also substantially aligned with the base opening 82.

The skirt portion 74 of the sponge base 42 comprises a side wall 84 defining a skirt edge 86. The side wall 84 extends downwardly from the plate portion 70 around the mounting portion 72. A cap surface 88 is formed on the side wall 84. A stop portion 90 of the cap surface 88 extends radially outwardly from the side wall 84.

The exemplary cap member 34 is or may be conventional in that it comprises a disc portion 92 and a wall portion 94. The exemplary cap member 34 further comprises a pin portion 96 that extends from the disc portion 92 within the wall portion 94. The wall portion 94 further defines an edge portion 98.

The cap member 34 may be selectively attached to or detached form the sponge assembly 32 by engaging the edge portion 98 of the cap member wall portion 94 with the side wall 84 formed on the skirt portion 74 of the sponge base 42. The edge portion 98 engages the stop portion 90 when the cap member 34 is secured to the sponge assembly 32. However, the edge portion 98 engages the cap surface 88 such that deliberate application of manual force on the cap member 34 can remove the cap member 34 from the sponge assembly 32.

Other systems and methods may be used to secure the cap member 34 relative to the sponge assembly 32. For example, complimentary threaded portions may be formed on the cap surface 88 and the edge portion 98 such that the cap member 34 is threaded onto the sponge assembly 32. Alternatively, the cap member 34 may be oversized such that it extends completely over the sponge assembly 32 and directly engages the container 30, preferably at the transition between the shoulder portion 52 and the main portion 50 of the container 30. If the cap member 34 directly engages the container 30, the skirt portion 74 of the sponge base 42 may be eliminated. The cap member 34 is not essential to the principals of the present invention, and the present invention may be embodied in a dispensing system 20 without a cap member.

When the edge portion 98 of the cap member 34 engages the cap surface 88 of the sponge base 42, the pin portion 96 extends into the sponge opening 46 in the sponge member 44. The pin portion 96 removes at least a portion of the dried texture material 22 within the sponge opening 46 and thus facilitates re-use of the system 20 after it has initially been opened.

With the sponge member 44 secured to the sponge surface 76 and the complimentary threaded surfaces 60 and 80 securing the sponge assembly 32 onto the container 30, the aligned sponge opening 46, base opening 82, and container opening 64 define a dispensing passageway 100 that allows material to flow out of the material chamber 58.

With the foregoing understanding of the dispensing system 20 in mind, the method of use of this system 20 will now be described in detail. Initially, the area 28 to be patched is preferably cleaned and otherwise primed or prepared, although the present invention may be implemented without this preliminary step.

The main portion 50 of the container 30 is then squeezed by hand or other method such that the container 30 deforms and the new texture material 22 is forced along the dispensing passageway 100 and onto the applicator surface 48.

As shown in FIG. 2, reference character 22*a* identifies a small portion of the new texture material 22 on the applicator surface 48. The entire container 30 is then displaced in the direction of arrow A such that the texture material 22*a* comes into contact with the surface 24 at the area 28 to be patched. Surface tension will cause at least a portion of the texture material 22*a* to adhere to the surface 24. At this point, the container 30 is displaced away from the surface 24 in the direction shown by arrow B, leaving a portion 22*b* of the new texture material 22 on the surface 24 at the area 28 to be patched.

The process of squeezing the container 30 to cause the texture material 22*a* to accumulate on the applicator surface 48, displacing the container assembly 30 as shown by arrow A such that the material 22*a* is deposited on the surface 24, and then withdrawing the container 30 in the direction shown by arrow B is repeated until the entire area 28 to be patched is covered with the texture material 22*b*.

The compressibility of the sponge member 44 is of significance in that the sponge member 44 does not define rigid edges or surfaces that will scrape and thus flatten the particulate within the texture material 22. In addition, the texture material 22*a* is daubed onto the surface 24 such that particulate material within the texture material 22 projects from the surface 24 in a manner similar to that obtained by an application process involving spraying. The daubing action used to apply the texture material 22 is substantially straight toward the surface 24 along the arrow A and substantially straight away from the surface 24 along the arrow B. The sponge member 44 is not wiped against the surface 24 during normal use.

To the contrary, a wiping action (movement substantially perpendicular to the direction shown by arrows A and B), would orient the particulate in the texture material 22 such that the particulate 38 is pressed into and embedded within the material 22 and does not extend from the surface 24. Again, the idea is to match the existing texture material 26, which in the vast majority of cases will have been blown or sprayed on using an air sprayer. The blowing process allows the particulate 38 to project out from the surface 24.

Clearly, the cap member 34 must be removed while the system 20 is used to apply the texture material 22 to the surface 24. After the first time the system 20 is used, the cap member 34 is fixed relative to the container such that the cap member 34 protects the sponge member 44 and facilitates re-use of the system 20 at a later time.

In particular, the dispensing system 20 is preferably distributed and sold with the container opening 64 unformed or possibly with an adhesive tab covering the container opening 64. If the container opening is unformed during distribution and sale, the opening 64 is formed by the end user immediately prior to use by piercing the surface 62 with a sharp object such as a knife, nail, screw driver or the life. If an adhesive tab is used, the user detaches the sponge assembly 32 from the container 30, removes the removable tab, and reattaches the sponge assembly 32 to the container 30.

Once the factory seal on the container opening 64 is broken by a method such as just described, air may infiltrate the material chamber 58 through this opening 64 and cause the material 22 therein to harden. The cap member 34 substantially seals the opening 64 and thus prolongs the life of the dispensing system 20 after it has initially been opened.

From the foregoing, it should be apparent that the present invention may be embodied in forms other than that described above without departing from the principals of the present invention. For example, the various components 30, 34, 42, and 44 are generally symmetrical about the dispensing axis 66. (e.g. cylindrical or frusta-conical or define cylindrical or frusta-conical surfaces). This configuration of parts is relatively easy to manufacture and is thus preferred. However, the present invention may be embodied with forms that are not symmetrical about an axis of rotation, and such other forms are considered within the scope of the present invention.

In addition, containers other than the exemplary container 30 described herein may be used. For example, cylindrical cartridges with a floating piston member are often used to dispense materials of this type. Such cartridges are placed into a squeeze gun that contains a ratchet mechanism that acts on the floating piston member to force the material out of the opening. This type of arrangement could also be used in conjunction with the principals of the present invention to apply more viscous texture materials such as stucco or the like to wall surfaces.

The scope of the present invention should thus not be determined with reference to the foregoing preferred embodiment.

What is claimed is:

1. A method of applying texture material to a destination surface defining a pre-textured portion formed by a spray system and an untextured portion, where the pre-textured portion comprises visually perceptible particles, the method comprising the steps of:

providing a flexible container defining a container opening, a container chamber, a first threaded surface, and a dispensing axis;

providing texture material comprising a base, a carrier, and particulate material, where the particulate material is at least one of sand, perlite, cork, polystyrene chips, and foam;

providing a sponge base defining a base opening and a second threaded surface;

providing a resilient sponge member defining a substantially planar applicator surface and a sponge opening;

forming a sponge assembly by adhering the sponge member to the sponge base such that the base opening and sponge opening are substantially aligned along the dispensing axis and the dispensing axis is substantially perpendicular to the applicator surface;

arranging the texture material within the container chamber;

displacing the sponge assembly such that the first threaded surface engages the second threaded surface to fix the sponge member relative to the container;

applying deliberate manual force to the container to force the texture material in the container chamber out of the container member and onto the applicator surface through the container opening;

transferring at least a portion of the texture material on the applicator surface to the untextured portion of the destination surface by displacing the container member along the dispensing axis towards the destination surface with the applicator surface substantially parallel to the destination surface;

displacing the container member away from the destination surface along the dispensing axis with the applicator surface substantially parallel to the destination surface such that an exposed portion of the particulate material on the untextured portion of the destination surface stands out from the destination surface and is visually perceptible, and the visually perceptible exposed portion of the particulate material transferred to the untextured portion of the destination surface substantially matches an appearance of the visually perceptible particles of the pre-textured portion; and allowing the carrier to evaporate such that the base adheres the particulate material to the destination surface to form a coat of new texture material that substantially matches an appearance of the textured portion of the destination surface formed by the spray system.

2. A method as recited in claim 1, further comprising the steps of providing a cap member and arranging the cap member to cover the sponge member.

3. A method as recited in claim 1, further comprising the steps of providing a cap member and causing the cap member to engage the sponge base and thereby cover the sponge member.

4. A method as recited in claim 1, in which the step of providing the texture material comprises the step of providing acoustic texture material.

5. A method as recited in claim 1, in which the step of providing the texture material comprises the step of providing stucco material.

* * * * *